US009376836B2

(12) United States Patent
Nirmel

(10) Patent No.: US 9,376,836 B2
(45) Date of Patent: Jun. 28, 2016

(54) MINIMALIZED KEYS AND BLANKS FOR SAME

(76) Inventor: Chittaranjan N. Nirmel, Warfordsburg, PA (US)

( * ) Notice: Subject to any disclaimer, the term of this patent is extended or adjusted under 35 U.S.C. 154(b) by 1694 days.

(21) Appl. No.: 12/456,261

(22) Filed: Jun. 15, 2009

(65) Prior Publication Data

US 2010/0313618 A1 Dec. 16, 2010

(51) Int. Cl.

| | |
|---|---|
| ***E05B 19/04*** | (2006.01) |
| ***E05B 19/00*** | (2006.01) |
| ***E05B 17/00*** | (2006.01) |
| *A45C 11/32* | (2006.01) |
| *A45F 5/00* | (2006.01) |

(52) U.S. Cl.

CPC ..... *E05B 19/04* (2013.01); *E05B 17/0062* (2013.01); *E05B 19/00* (2013.01); *E05B 19/0082* (2013.01); *A45C 11/324* (2013.01); *A45F 5/00* (2013.01); *A45F 2005/008* (2013.01); *Y10T 29/442* (2015.01); *Y10T 70/778* (2015.04)

(58) Field of Classification Search

USPC ..... 70/393, 402, 405, 406, 408, 410, 422

See application file for complete search history.

(56) References Cited

U.S. PATENT DOCUMENTS

| | | | | | |
|---|---|---|---|---|---|
| 1,979,960 | A * | 11/1934 | Coughlin | | 70/408 |
| 2,199,165 | A * | 4/1940 | Smith | | 70/341 |
| 2,855,810 | A * | 10/1958 | Brunner | | 70/406 |
| 3,457,746 | A * | 7/1969 | Glassman | A45C | 11/328 70/408 |
| 3,895,508 | A * | 7/1975 | Crasnianski | | 70/395 |
| 4,402,201 | A * | 9/1983 | Nokes | | 70/395 |
| 4,646,913 | A * | 3/1987 | Wing | A45C | 11/324 70/408 |
| 4,660,397 | A * | 4/1987 | Girimont | A45C | 11/321 70/456 R |
| 5,720,211 | A * | 2/1998 | Cahan | A45C | 11/325 83/452 |
| 5,768,924 | A * | 6/1998 | Song | | 70/408 |

* cited by examiner

*Primary Examiner* — Christopher Boswell

(57) ABSTRACT

A "minimalized" key has the smallest length, overall volume and weight commensurate with the ability to operate a lock in the same manner as a corresponding conventional key. It is easily formed from a conventional key blank, preferably after unique edge profiling to suit the lock, by eliminating the head portion and providing an aperture in the remaining body portion for attachment of means that facilitate application of a torque to turn it to operate the lock. Minimalized key blanks are also easily and inexpensively made from strip stock of rectangular cross-section of appropriate dimensions by forming longitudinal grooves and an aperture in selected lengths thereof, and the minimalized key blanks so formed are then individually profiled to make minimalized keys to fit specific locks. They may also be color-coded to make them visibly distinguishable from one another. Because of their small size, minimalized keys, individually or attached to others, may be conveniently and safely carried in open casings or discreetly on the user's person.

11 Claims, 5 Drawing Sheets

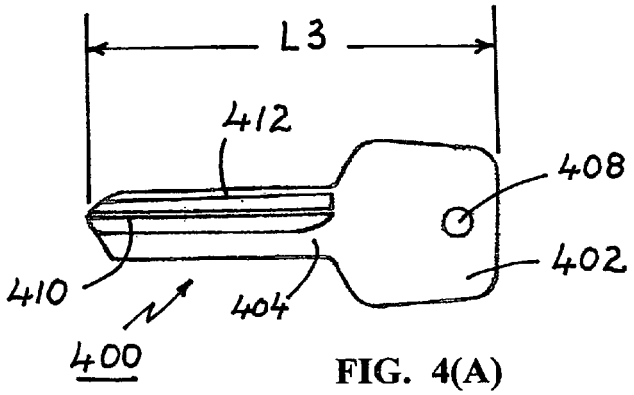
FIG. 4(A)
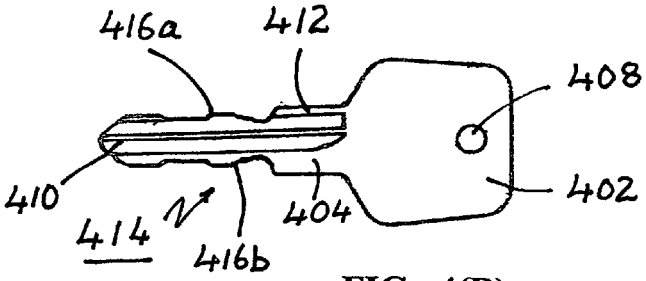
FIG. 4(B)
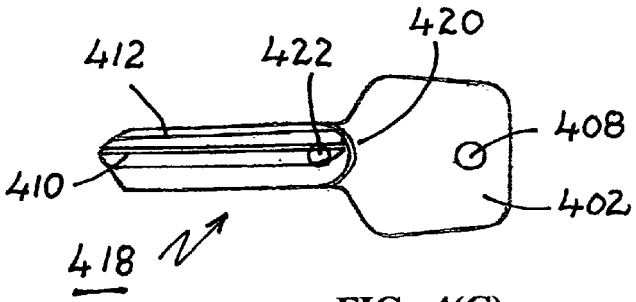
FIG. 4(C)
FIG. 5
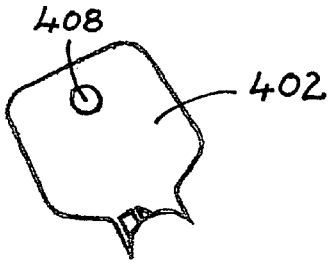
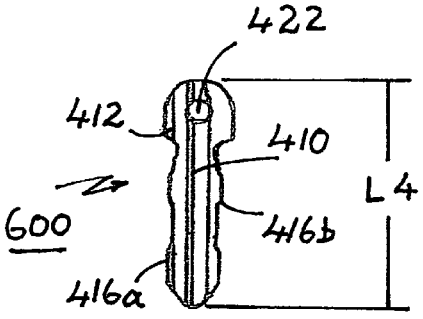
FIG. 6

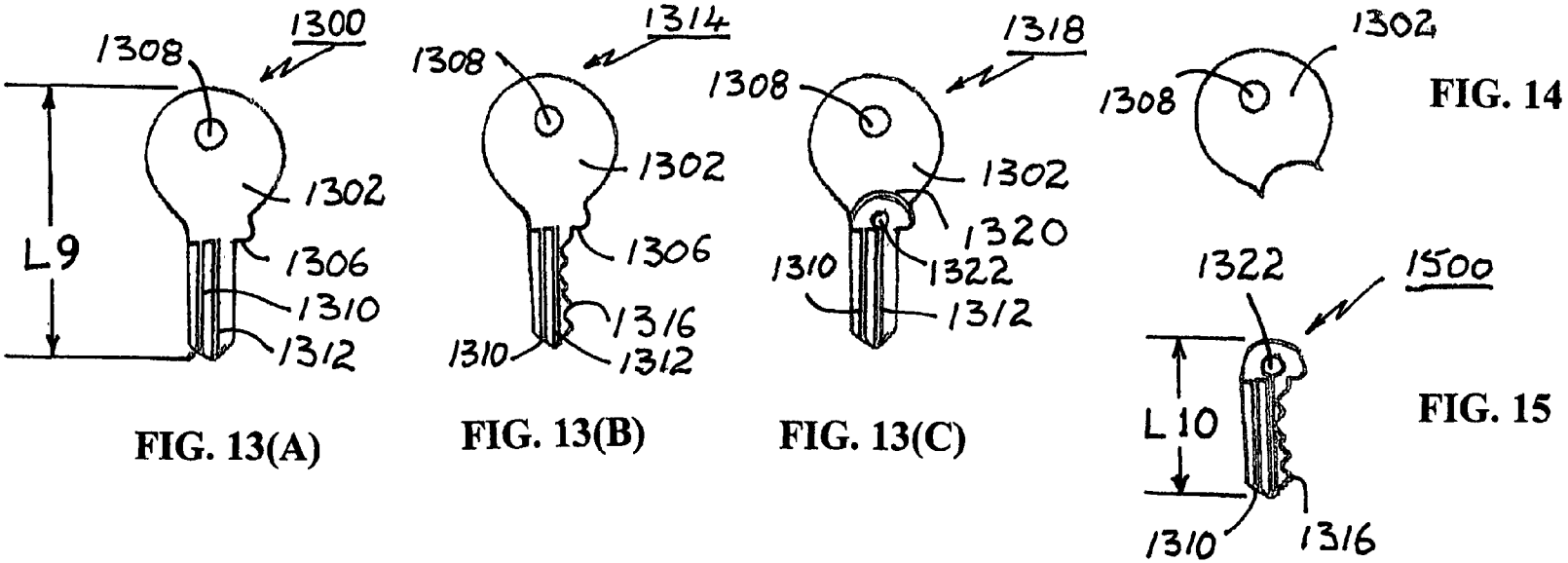
FIG. 13(A)
FIG. 13(B)
FIG. 13(C)
FIG. 14
FIG. 15
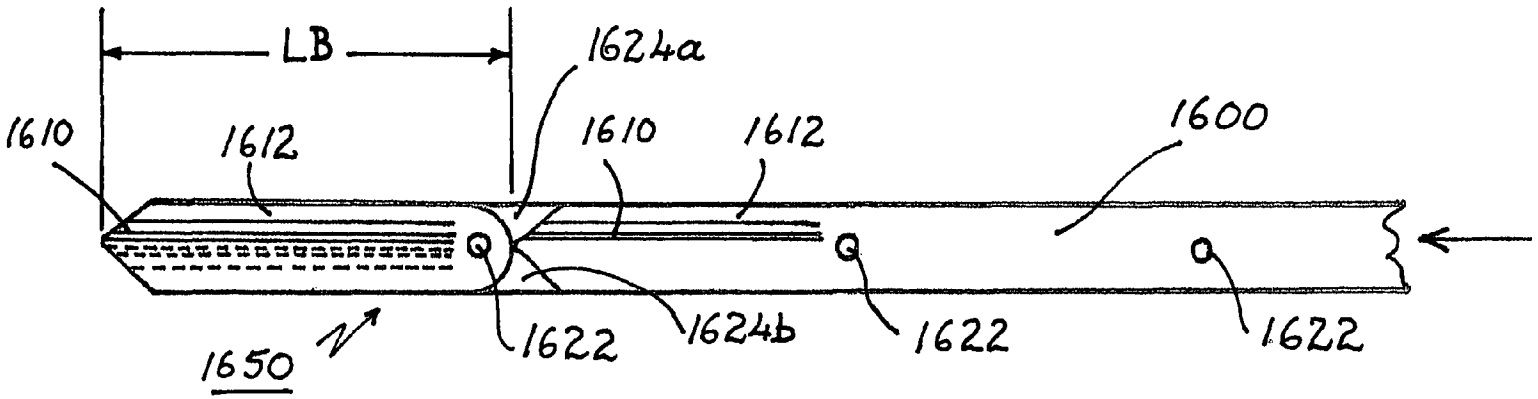
FIG. 16

MINIMALIZED KEYS AND BLANKS FOR SAME

FIELD OF THE INVENTION

This invention relates to new and improved key blanks and methods of making keys of minimal size and weight from them, the keys being of the kind that are inserted into a keyhole of a conventional lock and turned to operate the lock between its locked and unlocked states. More particularly, it relates to new and improved key blanks and to methods of making from them, and conveniently carrying, keys reduced to their respective minimums of length, overall volume and weight.

BACKGROUND OF THE RELATED ART

The conventional key of the kind that is typically inserted into a keyhole of a lock and turned to operate the lock between its "locked" and "unlocked" states comprises an essentially flat, grooved, edge-profiled, elongate body formed to be contiguous with a much wider and sometimes thicker flat head. Such a key is normally made from a preformed key blank rendered suitable for a particular type of lock by the provision of one or more grooves on one or both sides of the body, and is specifically machined to have unique profiling at one or both of its longitudinal edges to fit to a particular lock. Most such keys are made of a metal, e.g., steel, iron or brass.

The depth of insertion of the key into the lock's keyhole is determined either by the lock mechanism itself or sometimes by the provision of a small shoulder extending laterally outward from the key body about where it joins the head.

The head of the key is always made wider than its body—primarily to enable the user to apply sufficient torque to turn the key against the inherent resistance of the internal mechanism of the corresponding lock. Secondarily, the shape and size of the head make it easy for the user to recognize a particular key quickly from a number of them carried together. The key head is usually formed to have one or more holes through which the user can pass attachment means, e.g., a key ring, to retain it with other keys for convenient access.

Most people need to carry more than one key, e.g., for one or more vehicles, home and office doors, desks, file cabinets, office equipment, briefcases, safes, luggage, mailboxes and the like. Pluralities of such keys are therefore bunched together on key rings, clips, cords or other attachment means, and their users suffer carrying around their significant weight and volume, often all day at work, with varying degrees of tolerance.

It is possible nowadays to have such keys made from relatively lightweight alloys and composites, but the overall key structure still comprises the traditional elongate body extending into an enlarged head. The choice of a lightweight material thus reduces only the weight of the key somewhat, without affecting its body-plus-head structure, shape, overall volume and size. Inexpensive lightweight materials may not be as durable as the metals used earlier, so heavily used keys made from them may wear out rapidly and may need frequent replacement. These keys might also break more easily, which can lead to significant expense, embarrassment or worse. Sufficiently tough and durable lightweight materials tend to be expensive, and using them may also make it more difficult and/or expensive to machine a basic key blank into a key specific for a particular lock.

Given these facts, it is clear that a need exists for an affordable key that is significantly smaller and lighter in weight than the kinds currently available. The present invention addresses this need by providing key blanks and methods of forming "minimalized" keys from them that provide inexpensive, easy-to-use, smaller and lighter alternatives to conventional keys.

SUMMARY OF THE INVENTION

It is a principal object of this invention to provide an improved conventional key blank to form from it a minimalized key, i.e., a key of significantly reduced length, overall volume and weight, without significant inconvenience in its manner of use.

This object is realized by providing a conventional key blank corresponding to a particular lock, the blank having: an elongate body with a front end and a rear made contiguous with a wider head, the body having a cross-section defined between opposed parallel sides and opposed parallel edges; and a transverse groove cut part way into a thickness of the body to extend between the parallel edges, located so that a distance measured from the front end of the body to the transverse groove is larger than a predetermined operational depth of insertion of the body into the lock.

It is another object of this invention to provide an inexpensive key blank stock or work-piece from which a plurality of minimalized key blanks, i.e., individual key blanks from which keys of minimal length, overall volume and weight, may be formed to operate specific locks.

It is a further object of this invention to significantly reduce the overall volume and total weight of a plurality of keys, loosely attached to each other for convenience by shared attachment means like a key ring, key wallet, fold-in case or the like, to be safely and conveniently carried by users on their persons, pockets, belts, or inside personal accessory items like purses, handbags or briefcases.

It is an even further object of this invention to provide keys of minimal individual length, overall volume and weight in a manner that allows users to discreetly carry them out of sight directly on their persons or, at their option, as part of a fashion accessory or an item of personal wear.

In a related aspect of this invention, it is a principal object of this invention to provide a method of improving conventional key blanks so that they can be easily machined at one or both edges with conventional equipment to easily and inexpensively form keys of minimal length, overall volume and weight to replace conventional keys for individual locks.

This object is realized by providing a method of modifying a conventional key blank that has an elongate body with a front end and a rear contiguous with a head and is structured for a particular lock, to form a minimalized key blank for the same lock, by: forming into one side of the body a transverse groove extending across the width of that side, to a depth sufficient to enable deliberate breaking off of the head from the body at the transverse groove, and forming through a thickness of the body an aperture located so that a distance measured from the aperture to the front end is not less than a predetermined operational depth of key insertion for that lock for attachment thereat to attachment means.

It is a further related object of this invention to provide a method of forming a key of minimal length, volume and weight from a conventional key blank that is suitable for a particular lock.

This object is realized by providing a method of forming a minimalized key from a conventional key that has an elongate body with a front end and a rear contiguous with a head and is structured for operating a particular lock, comprising the steps of: forming an aperture through a thickness of the body at a distance from a distal end of the body that is not less than a predetermined operational depth of key insertion into the lock; and then physically separating the head from the body.

It is an even further related object of this invention to provide a method of forming keys of minimal length, overall volume and weight from a simple stock or work-piece.

This object is realized by providing a method of forming a minimalized key blank for a particular lock by: forming an aperture through the thickness of an elongate work-piece of selected material and cross-sectional dimensions corresponding to the lock, the aperture being located relative to a front end of the work-piece by not less than a predetermined depth of operational key insertion for the lock; advancing the work-piece by a distance equal to a predetermined length of the minimalized key; forming at least one longitudinal groove of predetermined cross-section and length, from a forward end of the work-piece into one side of the work-piece; and separating the advanced length of the work-piece from the rest of the work-piece.

These and other related objects will be understood from the detailed description provided below with reference to the cited drawing figures.

BRIEF DESCRIPTION OF THE DRAWING

FIGS. 4(A), 4(B), and 4(C), respectively, are: a plan view of a second conventional key blank, a plan view of a second conventional automobile ignition key made therefrom, and a plan view of a modified form of the second conventional key blank to easily form a second minimalized key from it.

FIG. 5 is a plan view of the separated head portion of the modified form of the second conventional automobile ignition key per FIG. 4(C).

FIG. 6 is a plan view of the second minimalized key that functionally replaces the second conventional automobile ignition key per FIG. 4(B).

FIGS. 13(A), 13(B), and 13(C), respectively, are: a plan view of a fifth conventional key blank, a plan view of a conventional mailbox lock key made therefrom, and a plan view of a modified form of the fifth conventional key blank to easily form a minimalized mailbox key from it.

FIG. 14 is a plan view of the separated head portion of the modified form of the conventional individual mailbox key per FIG. 13(C).

FIG. 15 is a plan view of the minimalized mailbox key that functionally replaces the conventional mailbox key per FIG. 13(B).

FIG. 16 is a schematic longitudinal plan view of an elongate work-piece to explain how minimalized key blanks are formed from it according to another preferred embodiment of this invention.

DETAILED DESCRIPTION OF THE PREFERRED EMBODIMENTS

Figure 1A:
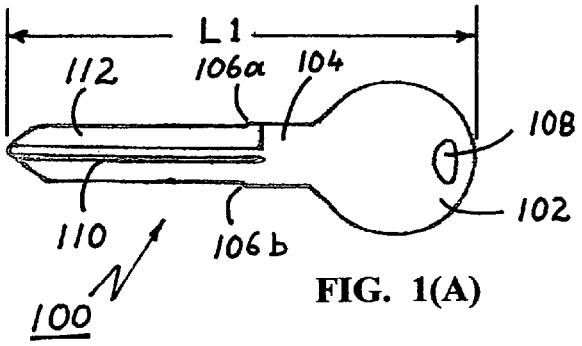
FIGS. 1(A), 1(B), 1(C) and 1(D), respectively, are: a plan view of a first conventional key blank, a plan view of a first conventional automobile ignition key made therefrom, a plan view of a modified form of the first conventional key blank to easily form a first minimalized automobile key from it, and a longitudinal cross-sectional view taken at Section A-A of that modified key blank.

FIG. 1(A) is a plan view of an exemplary conventional automobile ignition key blank 100 of overall length "L1". It has a round head 102, an elongate body 104, shoulders 106*a*, 106*b*, a single oval head aperture 108 for attaching the head to a known key attachment means, and grooves 110, 112 along a major portion on opposite sides of the body.

Body 104 is defined between parallel edges that must be uniquely profiled to convert the blank into a conventional key to suit a specific lock, and has a length measured from its front end that must exceed a predetermined operational depth to which such a key must be inserted into a keyhole of the lock. Shoulders 106*a*, 106*b* limit the operational depth of insertion of the key unless the lock mechanism itself is formed to do so. In all cases, the depth of insertion is a design parameter selected by the lock designer and is therefore a known dimension.

Figure 1B:
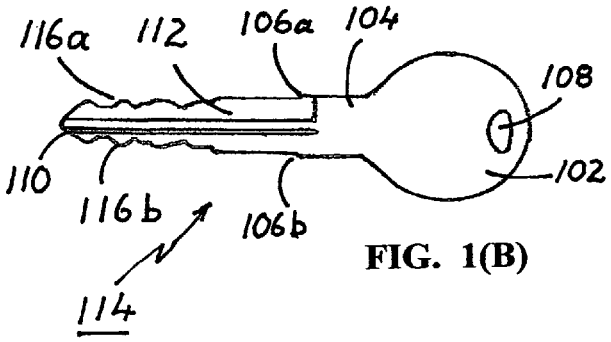

FIG. 1(B) is a plan view of a conventional key 114 formed from blank 100 by machining symmetric unique profiles 116*a*, 116*b* into both longitudinal edges of the body 104. It is these unique edge profiles that make blank 100 into a conventional key to operate a specific automobile. Groove 110 typically is of constant rectangular cross-section along its entire length. Groove 112 overlaps one of the edges. It therefore has a varying cross-section along its length. Such automobile keys typically are formed to be symmetric on both sides with respect to their grooves and edge profiles, and this gives the user freedom to insert the key into the ignition lock in either of two orientations.

Figure 1C:
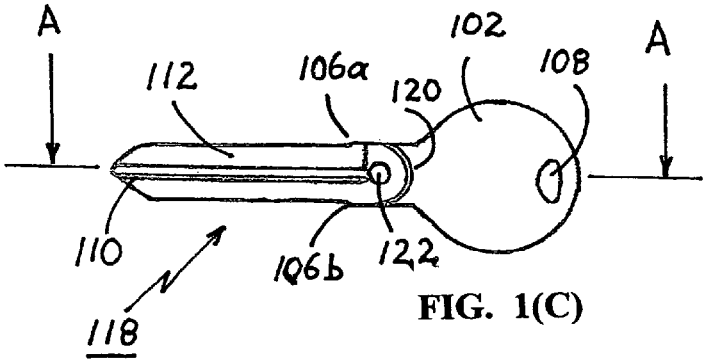
Figure 1D:
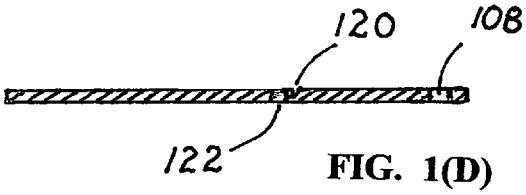

FIG. 1(C) is a plan view of a modified form 118 of the conventional blank 100, per the first embodiment of this invention. Modified blank 118 differs structurally from blank 100 in having a preferably arcuate groove 120 machined into the thickness of body 104 and across its full width such that it blends smoothly into the sides as shown. Groove 120 preferably has a narrow V-shaped cross-section, and extends at least half way into the thickness of body 104 as best understood by reference to FIG. 1(D). Modified blank 118 also has a small aperture 122 formed centrally through the thickness of body 104, preferably close to and within the curve of groove 120, in part to perform the same function as aperture 108 following some more processing.

Figure 2:
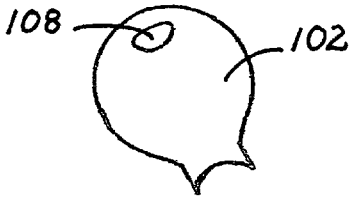
FIG. 2 is a plan view of the separated head portion of the modified form of the first conventional automobile ignition key per FIG. 1(C).

Groove 120 is intended to physically weaken modified blank 118, but not to the extent that the modified blank cannot be held securely in a conventional "key-cutting" machine while profiles 116*a* and 116*b* are being cut into its edges. Groove 120 is made deep enough, however, so that following the step of cutting of profiles 116*a*, 116*b* the head portion 102 can be snapped off smartly and physically separated from body 104 in the next step. The material of head portion 102, best seen in FIG. 2, can be recycled along with any scrap cut off during the profiling step and the drilling of apertures 108 and 122.

Figure 3:
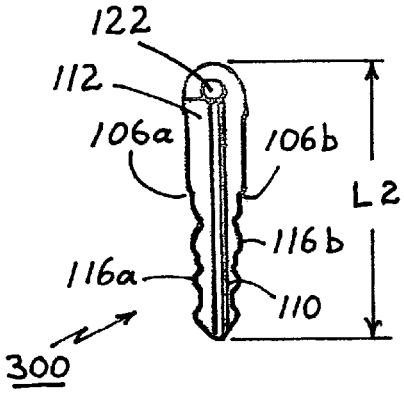
FIG. 3 is a plan view of the first minimalized key that functionally replaces the first conventional automobile ignition key per FIG. 1(B).

The step separating head 102 from profiled body 104 results in the production of a minimalized key 300, as best seen in FIG. 3. In a final step, any sharp edges or points left on minimalized key 300 can be cleaned up in any known manner, e.g., by filing and/or wire brushing.

Minimalized key 300, having the same machined grooves 110, 112 will function to operate the same lock as conventional key 114, in essentially the same way, i.e., by insertion of its front end into the keyhole of its lock followed by turning as required to operate the lock to its locked or unlocked state. It can be bunched and carried around with other keys, minimalized or conventional, via any known key attachment means.

The minimalized key is most conveniently turned after insertion into the lock by applying a torque to it via an attachment means like a key ring or the like. Such a key ring could be as small as 34 in. in diameter, which would add very little to the overall volume or weight of even a single minimalized key. When a number of keys are held together for the user's convenience by any known attachment means, this manner of applying a torque with it to turn any one of the keys thus becomes a very simple matter.

If the conventional key blank does not have at least one shoulder to limit how far the key can be inserted into its lock then the minimalized key formed from it also will lack a shoulder. This may matter with some locks. In such a case, deliberate choice of the location of aperture 122, and the presence of a portion of a key attachment means passing therethrough, will limit the extent of insertion of the minimalized key. The choice of location may be done by either the locksmith cutting the profiles or by a user inserting the conventional blank into the lock and scoring a line at the keyhole to provide guidance on where to locate aperture 122 in the process of making the minimalized key.

As is both very important and immediately apparent, minimalized key 300 has an overall length "L2" significantly shorter than length "L1", and a much smaller overall volume and weight than corresponding conventional key 100. Note that head 102 typically has only one aperture 108 tending to reduce its volume and weight, whereas minimalized key 300 is much less "solid" because it has grooves 110 and 112, aperture 122 and reduced material because of profiles 106*a*, 106*b* machined out of its edges.

FIG. 4(A) is a plan view of another conventional blank 400 for forming a second common type of automobile ignition key 414, per FIG. 4(B), just as was previously described with regard to blank 100 and key 114. Blank 400 differs structurally from blank 100 in having a polygonal head 402, a wider body 404, no shoulders, a round aperture 408 in its head, and grooves 410 and 412 both initially of constant cross-section.

Key 414, best seen in FIG. 4(B), is formed from blank 400 by cutting profiles 416*a*, 416*b*. Groove 412 then has a varying cross-section along its length. This key, like many automobile ignition keys, is symmetric on both sides.

Modified key blank 418 is formed from blank 400, per the first embodiment of this invention, by forming a curved groove 420 and a through aperture 422 in it, for the same reasons as were described earlier in relation to the first modified key blank 118. When profiles 416*a*, 416*b* are then cut into the edges of modified blank 418, and head 402 is forcibly separated per FIG. 5, one obtains minimalized key 600 that will operate the same ignition lock as key 400 in essentially the same way. Minimalized key 600 can be assembled with other keys by applying known attachment means via aperture 422.

Note that minimalized key 600 has a length "L4" that is much shorter than length "L3" of corresponding conventional key 400, and also has significantly less overall volume and weight.

Figures 7A, 7B, 7C, 8, 9, 10A, 10B, 10C, 11, 12:
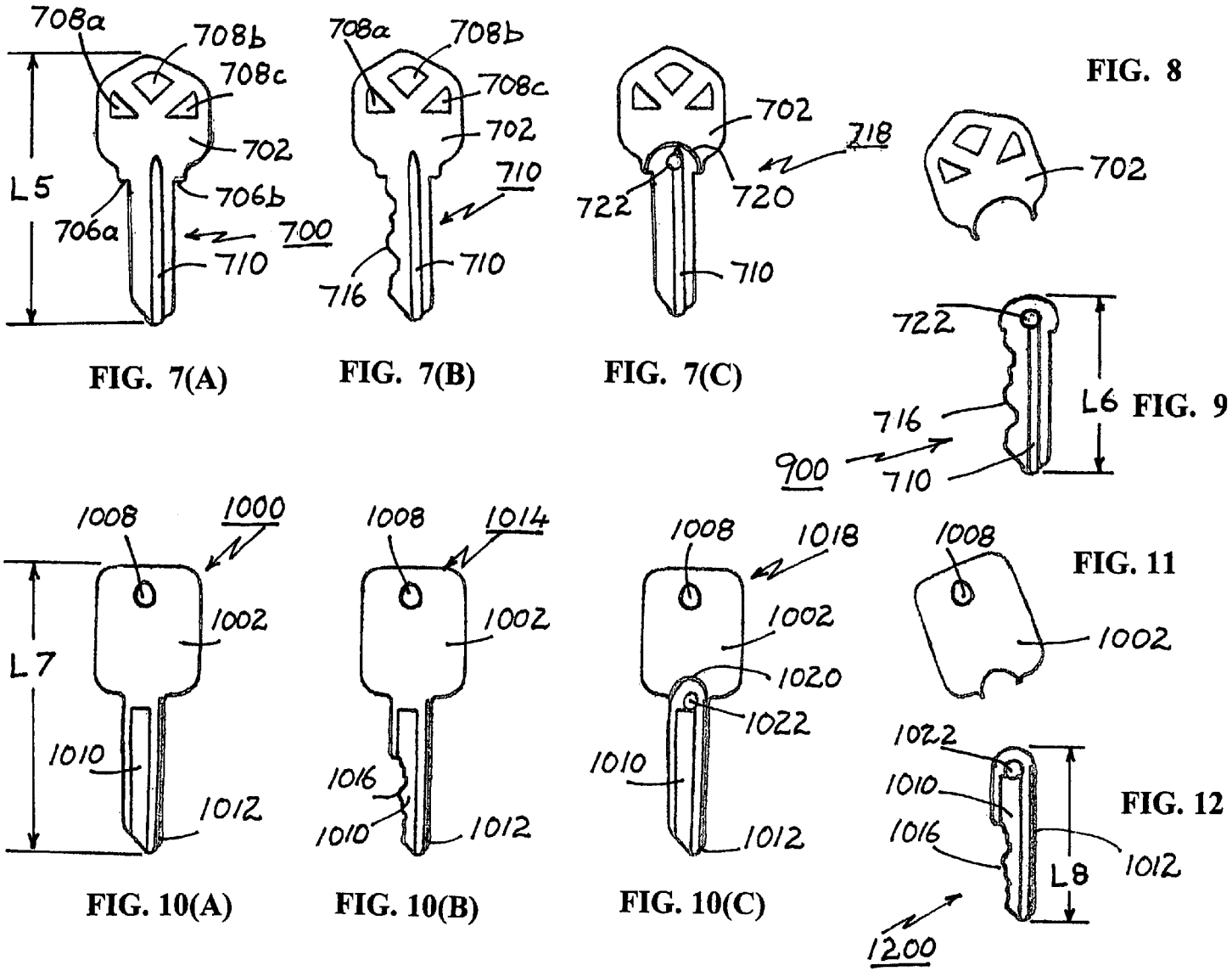
FIGS. 7(A), 7(B), and 7(C), respectively, are: a plan view of a third conventional key blank, a plan view of a conventional door lock key made therefrom, and a plan view of a modified form of the third conventional key blank to easily form a minimalized door lock key from it.
FIG. 8 is a plan view of the separated head portion of the modified form of the conventional door lock key per FIG. 7(C).
FIG. 9 is a plan view of the third minimalized key that functionally replaces the conventional door lock key per FIG. 7(B).
FIGS. 10(A), 10(B), and 10(C), respectively, are: a plan view of a fourth conventional key blank, a plan view of a conventional individual lock key made therefrom, and a plan view of a modified form of the fourth conventional key blank to easily form a minimalized individual lock key from it.
FIG. 11 is a plan view of the separated head portion of the modified form of the conventional individual lock key per FIG. 10(C).
FIG. 12 is a plan view of the minimalized individual lock key that functionally replaces the conventional individual lock key per FIG. 12(B).

FIGS. 7(A), 7(B), and 7(C), are respective plan views of a conventional key blank 700, a conventional key 714 made from blank 700, and a modified blank 718 formed from a conventional blank 700 by forming into it groove 720 and through aperture 722 for the same reasons as explained earlier. Key 714 is of a type suitable for operating locks in doors, e.g., for residences, garages, offices, etc.

As best seen in FIG. 8, head 702 is forcibly separated from body 704 at groove 720, and its material may then be recycled as appropriate. The minimalized key 900 thus obtained, as best seen in FIG. 9 and as will now be easily understood, has a much shorter length, overall volume and weight then corresponding conventional key 714 to operate the same door lock. Note that the shoulders 706*a*, 706*b* are at least partly preserved for their intended purpose by suitable location of groove 722. Conventional door lock keys typically have a unique profile on only one edge. Minimalized key 900 has the same single profiled edge as corresponding conventional key 714.

Redundant descriptions will be omitted hereafter for conciseness, and it is expected that persons of ordinary skill in the mechanical arts will easily understand and correctly interpret FIGS. 10(A) through 15 on the basis of the earlier descriptions. Key 1014, best seen in FIG. 10(B), is of a kind used to operate individual portable locks, e.g., the kind commonly used to lock sheds, gate chains, trunks, latches and the like. It has a rectangular head 1002, an elongate body 1004, no shoulders, an oval aperture 1008 for attaching to known attachment means, a groove 1010 only partially of constant cross-section, a groove 1012 of constant cross-section, and a profile 1016 machined into only one of its longitudinal edges. Minimalized key 1200, best seen in FIG. 12, in comparison with corresponding conventional key 1014 has significantly shorter length, overall volume and weight.

FIGS. 13(A) through 15 similarly relate to a kind of key typically used with built-in locks on items like suitcases, small luggage bags, backpacks and briefcases. Even though conventional key 1314 is quite small, the corresponding minimalized key 1500, best seen in FIG. 15, is significantly smaller and weighs less.

Innumerable other forms of keys within the class of keys of current interest exist, and they no doubt include a number of the features described above with reference to five examples of the commonest kinds. The benefits of this invention clearly are applicable to a very wide variety of such keys.

This invention utilizes the fact that the body of a key, i.e., the portion of the conventional key structure that comprises the groove(s) and edge profile(s) and is inserted into and turned to operate a corresponding lock, is all that is really needed to functionally and structurally define the key. The conventional key head really is superfluous and may be discarded to realize the benefits of smaller size and weight. The head serves only two purposes: first, it allows a user to hold and turn the key in the keyhole of a lock, and, second, it may help the user quickly recognize a particular key. As discussed below, there are other ways to be able to turn the key conveniently. The second benefit, easy recognition, may not be significant when the bunch of keys at hand comprises two or more keys with the same overall size and shape. This is a likely occurrence for someone like a building superintendent who often has to deal with two or more similar locks operable by keys that differ only in details of their edge profile(s). A known solution for this is to use color-coding, i.e., coloring at least a part of each similar key with a different color—either in toto or in part. This efficient solution is easily incorporated into the present invention to the extent necessary.

The principal focus of this invention therefore is on providing key blanks that permit easy and economical reduction of the length, volume and weight of the body structure that is essential to the key's function, i.e., operating a particular lock.

The cut-off head portions and any metal bits or dust generated in creating the "headless" key bodies as described above can be saved for recycling of the metal. This realizes the first two benefits of this invention: (1) more efficient use of resources, and (2) lower material cost for each "headless" key.

The reduction in length, volume and weight in going from the conventional to the "headless" key structure needs to be fully appreciated. The figures are all drawn to scale, so some of this information is immediately apparent. Some aspects, however, require more consideration. Each identified benefit is discussed below.

Reduction in Length of a Key in Going from Conventional to "Minimalized" Form:

This is estimated to range from about 35% for keys 714/900 to about 42% for keys 1014/1200.

Reduction in Volume:

Note that "overall volume" in the present context means the amount of space practically occupied by a key and thus made unavailable for other purposes inside a container such as a person's pocket or a purse. This is greater than the actual volume of the material used to make a key because while the grooves and apertures reduce the volume of material left in a key they do not make any commensurate useful space available to a user. The relevant and useful reduction in "overall volume" is estimated to range from about 60% for keys 1014/1200 to about 70% for keys 414/600.

Reduction in Weight:

Note that the head portions are much more "solid" than the grooved and profiled body portions, so that the weight reduction realized by eliminating the head portions is greater than might seem from a look at just the plan views of their areas. With this in mind, the "weight reduction" is estimated to range from about 65% for keys 1314/1500 to about 78% for keys 414/600.

These three estimated benefits are additional to the two listed earlier, i.e., savings in raw material and lower cost of needed material in going from the conventional to the "minimalized" key structure as disclosed herein.

A second embodiment of this invention starts with modified conventional key blanks manufactured with the transverse groove such as 120, 420 or the like included, with the head aperture such as 108, 408 or the like omitted. The figures discussed above make it clear that the modified key blanks per the second embodiment would be those per FIGS. 1(C), 4(C), 7(C), 10(C) and 13(C), respectively, except without apertures such as 108, 408, 708, 1008 and 1308. This would involve an almost insignificant change in the manufacturing cost, but the person making the edge profiles could do so very easily with known equipment, then break off the head, and smooth out any remaining roughness or sharpness to thereby produce the corresponding minimalized key. A user could provide the profile-cutter a conventional key for its profile and the latter could inexpensively make a copy that is a correspondingly profiled but much smaller and lighter mimimalized key that would be a functional duplicate. Some users might prefer to keep a set of minimalized keys as compact spares where they can be readily found when needed.

A third embodiment of this invention is highly suitable for an original lock manufacturer. In this embodiment, one starts with a straight elongate stock or work-piece 1600, as best seen in FIG. 16. It would be made of a suitable material to a length of many feet, and be of rectangular cross-section with a width and thickness selected for a particular minimalized key type appropriate for a certain model of locks.

In the first step, stock 1600 would be advanced by a length "LB" equal to the length of the desired minimalized key blank and an aperture 1622 drilled or punched into it along a central axis. In the alternative, these apertures could be formed along the entire length of work-piece 1600 ab initio. In the second step, grooves such as 1610, 1612 would be cut in on one or both sides as desired. In the third step, the material segments 1624*a*, 1624*b* would be removed so that the desired minimalized key blank 1650 is separated from the parent work-piece 1600. In the fourth step, all sharp or pointed edges would be smoothed out if necessary. Such minimalized key blanks could then be stocked at hardware stores for retail profiling of minimalized keys to suit individual customers.

A preferred alternative would be for the lock manufacturer to go one step further and cut appropriate profiles along one or both edges of minimalized key blank 1650 to finish it into a functional minimalized key for a particular lock. The provision of such minimalized keys in addition to, or in place of, conventional keys almost certainly would enhance the appeal of a manufacturer's locks—it would certainly give the customer the full benefit of minimalized keys per this invention without significant added cost.

Figure 17:
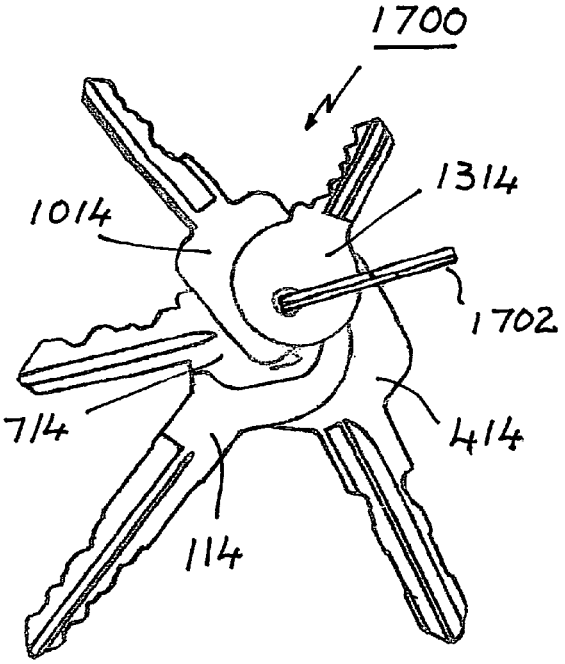
FIG. 17 is a plan view of a bunch of the five conventional keys, per FIGS. 1(B), 4(B), 7(B), 10(B) and 13(B), loosely attached to each other with a conventional key-ring.
Figure 18:
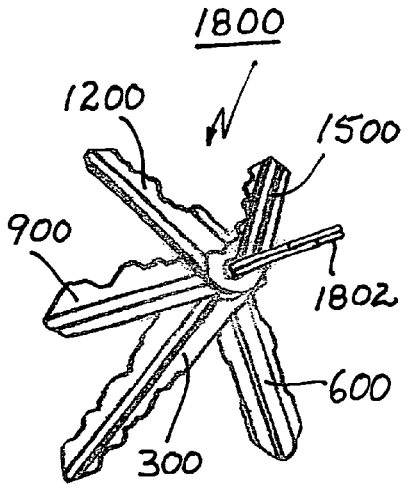
FIG. 18 is a plan view of a bunch of the corresponding five minimalized keys, per FIGS. 3, 6, 9, 12 and 15, also loosely attached to each other in the same disposition as their counterpart conventional keys in FIG. 17 with a smaller conventional key-ring.

FIGS. 17 and 18, considered together, make it clear just how much difference there is in the physical size between a bunch 1700 of just five conventional keys on a conventional key ring 1702 as compared to a corresponding bunch 1800 of minimalized keys carried on a smaller key ring 1802. The resulting weight reduction should also be apparent. A key ring about ⅞ in. diameter, as shown, would enable the user to comfortably turn a minimalized key in a lock while holding the ring and the other minimalized keys together in one hand. Many people regularly carry more than five keys, so they would experience an even greater reduction in volume and weight by going to minimalized keys.

Figure 19A:
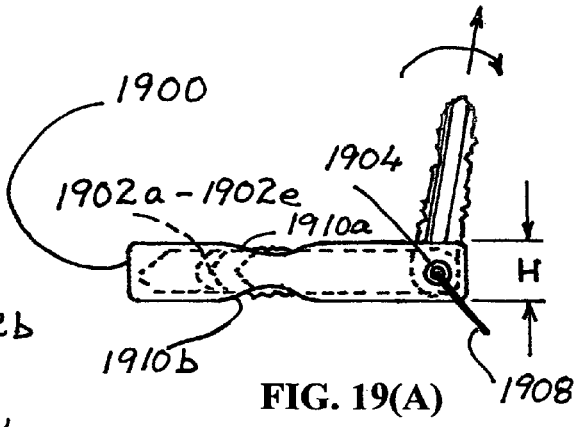
FIGS. 19(A) and 19(B), respectively, are side-elevation and plan views of a compact key-containment casing for holding together a plurality of up to seven minimalized keys, for selective use thereof to operate corresponding locks.
Figure 19B:
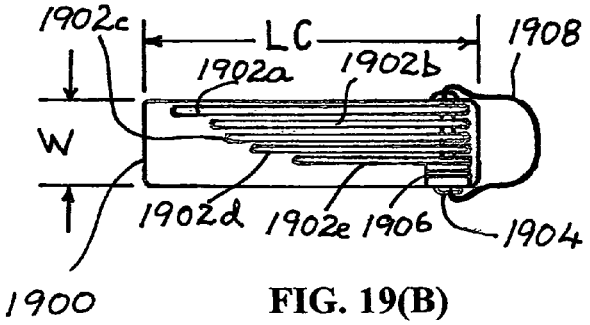

FIGS. 19(A) and 19(B) show the preferred rectangular shape and size of an open cubical casing 1900 for conveniently carrying and using up to seven minimalized keys very compactly. FIG. 19(B) shows only five minimalized keys 1902*a*-1902*e* in casing 1900, held together therein preferably by a transverse pin 1904 extending through the apertures (not visible in the figures) provided in the keys. The length "LC" of casing 1900 must be a little longer than the length of the longest minimalized key 1902*a* to be carried therein. Similarly, the height "H" of casing 1900 preferably is at least as large as the width of the widest minimalized key 1902*e* carried therein.

FIG. 19(B) shows only five minimalized keys within casing 1900, although there is room for at least two more. Washers 1906, of suitable thickness and in suitable numbers, are included to fully occupy the inside width of casing 1900 when it is not occupied entirely by keys. This is needed to properly hold the keys firmly in place, and it also allows the user to ensure this by changing the number and/or thickness of the washers if one or more keys is removed or added. Washers made of a light metal, alloy or a hard plastics material such as nylon or PVC would be suitable.

A half-ring 1908 may be included, clipped on to recesses formed in the ends of pin 1904, to allow the user to attach casing 1900 to a belt-clip or the like.

Casing 1900 preferably has inward reliefs 1910*a*, 1910*b* on opposite sides, as best seen in FIG. 19(A), to allow the user to easily push the keys out of casing 1900 when they are to be used. Once the proper key is selected the others can be pushed back into casing 1900, and the casing itself used to comfortably turn the chosen key, as indicated in FIG. 19(A), after it is inserted into a lock. By suitable choice of the relevant dimensions, one can expose just enough of a particular minimalized key out of casing 1900 to ensure that it penetrates the lock to the correct depth.

As will be apparent, a casing like 1900 could be made slim enough to accommodate just one minimalized key. This would make it small enough to be slipped into a money-belt or even a pocket on a sports shoe.

Figure 20:
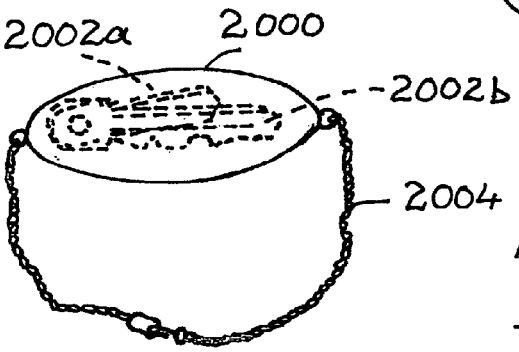
FIG. 20 is a schematic frontal view of an exemplary item of personal ornamental wear suspended from a chain of suitable length that can be worn by the user on an ankle, wrist or around the neck, within which a pair of coupled mimimalized spare keys may be carried discreetly, i.e., out of sight.

FIG. 20 shows an exemplary ornamental object 2000 within which one or two pinned-together minimalized keys 2002*a*, 2002*b* could be hidden to be carried, e.g., on a chain 2004 or the like, on a user's wrist, ankle or neck. This would be a very neat way for a latch-key child to discreetly carry extra house keys. Likewise, a person going on a long trip may find it comforting to have extra keys well hidden upon his or her person for use in an emergency, e.g., if the regularly used set of keys is lost or stolen while the user is far from home.

Experiments have established that while it is possible for a person with a strong thumb-and-forefinger grip to hold and turn an isolated minimalized key to open, for example, an automobile door lock or to operate the vehicle's ignition switch, such a simple scenario is not very practical for most users. One simple solution, in a pinch, would be to sandwich the proximate end of the minimalized key between two coins to facilitate its turning to operate a lock. Another would be to insert a common nail into the attachment aperture, e.g., 122, 422, etc., to obtain comfortable torque application.

Persons of ordinary skill in the art will no doubt consider making obvious modifications of the disclosed invention. Such variations are considered comprehended herein, and the present invention is limited solely by the claims appended below.

The invention claimed is:

1. An improved conventional key blank having an elongate body and a head, for forming a minimalized key to operate a lock, wherein the improvement comprises:

a transverse groove located between the head and the body, formed into a thickness of the body to extend transversely across a width of the body, the groove being of a depth such as to facilitate deliberate breaking off of the head from the body thereat.

2. The improved conventional key blank according to claim 1, further comprising:

an aperture located intermediate a distal end of the body and the groove and extending through the thickness of the body, separated from the distal end of the body by a distance not less than a predetermined operational depth of key insertion for the lock.

3. An improved conventional key blank for forming a minimalized key to operate a particular lock, comprising:

a conventional key blank corresponding to the lock, having an elongate body with a front end and a rear made contiguous with a wider head, the body having a cross-section defined between parallel sides and parallel edges; and a transverse groove cut part way into a thickness of the body to extend between the parallel edges, located so that a distance measured from the front end of the body to the transverse groove is larger than a predetermined operational depth of insertion of the body into the lock.

4. The improved conventional key blank according to claim 3, further comprising:

an aperture located intermediate the front end of the body and the transverse groove, extending through the thickness of the body and separated from the front end by a distance not less than the predetermined operational depth of key insertion for the lock.

5. The improved conventional key blank according to claim 3, wherein:

the groove is arcuate and is configured to smoothly blend in with the parallel edges.

6. A method of improving a conventional key blank that has an elongate body with a front end and a rear end contiguous with a head and is structured for forming a conventional key for a particular lock, to form a minimalized key blank for the same lock, the method comprising the step of:

forming into one side of the body a transverse groove located so that a distance measured from the front end of the body to the transverse groove is larger than a predetermined operational depth of insertion of the body into the lock and extending across the width of that side, to a depth sufficient to enable deliberate breaking off of the head from the body at the transverse groove.

7. The method according to claim 6, comprising the further step of:

forming an aperture through a thickness of the body at a distance from the first end not less than the predetermined operational depth of the key insertion for the lock.

8. The minimalized key blank formed according to claim 6, further comprising:

means for discreetly carrying the minimalized key within an item of personal wear for a user.

9. The method according to claim 6, wherein:

the groove is arcuate and is configured to blend in with edges defining the width of the body.

10. A method of forming a minimalized key from a conventional key that has an elongate body with a front end and a rear contiguous with a head and is structured for operating a particular lock, comprising the step of:

forming an aperture through a thickness of the body at a distance from a distal end of the body that is not less than a predetermined operational depth of key insertion into the lock; and separating the head from the body.

11. The method according to claim 10, wherein:

the step of separating the head from the body results in the formation of a curved proximal end of the body that is smoothly blended to opposite edges defining a width of the body.

* * * * *